US008952324B2

(12) United States Patent
Sasaki et al.

(10) Patent No.: US 8,952,324 B2
(45) Date of Patent: Feb. 10, 2015

(54) MASS ANALYZING APPARATUS, ANALYZING METHOD AND CALIBRATION SAMPLE

(75) Inventors: Midori Sasaki, Hitachinaka (JP); Terumi Tamura, Hitachinaka (JP); Shinya Ito, Hitachinaka (JP); Makoto Nogami, Tsuchiura (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/978,445

(22) PCT Filed: Dec. 27, 2011

(86) PCT No.: PCT/JP2011/080272
§ 371 (c)(1),
(2), (4) Date: Jul. 5, 2013

(87) PCT Pub. No.: WO2012/093622
PCT Pub. Date: Jul. 12, 2012

(65) Prior Publication Data

US 2013/0277542 A1 Oct. 24, 2013

(30) Foreign Application Priority Data

Jan. 7, 2011 (JP) ..... 2011-001655

(51) Int. Cl.
*H01J 49/26* (2006.01)
*H01J 49/00* (2006.01)

(52) U.S. Cl.
CPC ..... *H01J 49/0009* (2013.01)
USPC ..... 250/282; 250/281; 250/288; 702/23; 702/27; 702/28

(58) Field of Classification Search
USPC ..... 250/281, 282, 288; 702/19, 22, 23, 24, 702/25, 26, 27, 28
See application file for complete search history.

(56) References Cited

U.S. PATENT DOCUMENTS

2006/0097144 A1* 5/2006 Kingston et al. ..... 250/282
2009/0163383 A1* 6/2009 Sun et al. ..... 506/27

FOREIGN PATENT DOCUMENTS

JP 05-079984 3/1993
JP 05-264506 10/1993
JP 2000-065797 3/2000

OTHER PUBLICATIONS

JP Office Action for Japanese Patent Application No. 2012-551839, issued on Aug. 13, 2013.

*Primary Examiner* — Nicole Ippolito
(74) *Attorney, Agent, or Firm* — Antonelli, Terry, Stout & Kraus, LLP.

(57) ABSTRACT

The mass analyzing apparatus of the present invention can achieve the speed-up and simplification of the formation of a calibration curve for quantifying an analysis object in a mass analyzing apparatus. The mass analyzing apparatus is provided with: a sample storage-dilution unit 1 for storing samples of the analysis object including a quantitative calibrator in which, with respect to one analysis object to be quantified, two or more kinds of compounds selected from the analysis object, a plurality of stable isotope compounds of the analysis object and a plurality of analogue compounds of the analysis object are mixed at respectively different concentrations; an ionizing unit 5 for ionizing a sample; a mass analyzing unit 6 for analyzing the ionized sample; and a data processing unit 7 in which, based on results of analysis of the quantitative calibrator carried out by the mass analyzing unit 6, two or more concentrations are measured, and the analysis object is quantified based on information of the measurement.

11 Claims, 3 Drawing Sheets

MASS ANALYZING APPARATUS, ANALYZING METHOD AND CALIBRATION SAMPLE

TECHNICAL FIELD

The present invention relates to an analyzing method for quantifying an analysis object in a mass analyzing apparatus and to a mass analyzing apparatus.

BACKGROUND ART

When performing a quantitative analysis of an analysis object, it is normally necessary that the analysis object is measured at two or more respectively different concentration points to form a calibration curve based on its results by a relationship between a signal intensity and a concentration. Depending on the stability of a mass analyzing apparatus, it is sometimes necessary to form the calibration curve every several hours or every day or for every analysis object.

In order to improve the precision of a calibration curve, normally, a calibration curve is formed by using three or more concentration points. This is because the calibration curve sometimes fails to form a straight line for the reasons of saturation of a detector, deviations in measurements and the like.

In the case where a calibration curve is formed for quantifying an analysis object in optical measurements, since the same substance is detected as the same wavelength, it is impossible to measure multiple concentrations at the same time, and the calibration curve needs to be formed by measuring the analysis object at respectively different concentrations. In general, a multi-calibrator capable of calibrating analysis objects of multiple items is used for the biochemical inspections by the optical measurements, but this corresponds to a sample in which analysis objects each at one concentration point that do not interfere with one another are mixed, and this is not a sample including the same substance at multiple concentration points.

On the other hand, also in the mass analyzing apparatus used in the present invention, in order to form a calibration curve for quantifying an analysis object with high precision, it is necessary that the analysis object is measured at least two or more respectively different concentration points to form a calibration curve based on the results of measurement by a relationship between a signal intensity and a concentration.

In a general mass analyzing method, after ionizing an analysis object, various kinds of generated ions are taken in a mass analyzing apparatus, and a measurement intensity for ions is determined for each of the values of mass-to-charge ratio (m/z) that is a ratio of the mass number of ions and the charge thereof. Mass spectrum data obtained as a result include peaks of measurement intensity of the measured ions relative to each of the mass-to-charge ratios. In other words, the mass analyzing apparatus can simultaneously detect the substances as long as the substances have different masses.

Moreover, in an analysis of a sample containing many foreign components as in the case of a biological sample, in an attempt to distinguish an analysis object from its analogue structural molecules such as its metabolites or the like, a tandem mass analyzing method (MS/MS method) is used. In this MS/MS method, among multiple kinds of ions generated from an introduced sample, ions of a specific measurement object component are made to collide with a gas or the like to be dissociated in an analyzing apparatus and the generated ions (product ions) are measured. By using the MS/MS method, analogue structural components can be mutually distinguished with high precision. More specifically, it becomes possible to perform the measurement of only the measurement object in which foreign components that have analogous structure to the measurement object and are not desired to be measured are excluded. Thus, even if there are foreign component ions that have the same mass number as that of the measurement object ions, it is possible to distinguish the measurement object ions when the product ions are different from each other.

When it is desired to accurately quantify an analysis object in a mass analyzing apparatus, in general, a stable isotope compound of the analysis object that is isotope-labeled or a compound that is analogous thereto in chemical and physical properties (hereinafter, referred to as an analogue compound) is used as an internal standard substance. As the internal standard substance, a stable isotope compound and an analogue compound whose response to the mass analyzing apparatus is analogous to the analysis object and which can be measured separately from the analysis object are selected.

In other words, in the measurement in the mass analyzing apparatus, the analysis object, its stable isotope compound and analogue compound exhibit the same behaviors in fluctuations in peak intensity, and in the case where a reduction in the peak intensity, a reduction in ionization efficiency or the like occurs due to any factor such as foreign components, the increase or decrease of a peak area exhibits the same behaviors as that of the analysis object. Herein, when the product ions are detected, the stable isotope compound to be used needs to be a compound in which an element contained in the product ions is isotope-labeled.

More specifically, in order to form a calibration curve for quantifying the analysis object in the mass analyzing apparatus with high precision, it is necessary to prepare two or more solutions obtained by mixing an analysis object and an internal standard substance at different concentration points, and perform the measurement at least twice or more.

As described above, in order to form a calibration curve with high precision, multiple kinds of analysis objects having different concentrations have to be prepared, and the analysis has to be carried out at least twice or more, and consequently, time-consuming tasks are required for the preparations and analysis of those samples. Moreover, there is a possibility that human errors occur when preparing the multiple kinds of quantitative calibrators and performing the measurements thereof.

For this reason, in Japanese Patent Application Laid-Open Publication No. H5-79984 (Patent Document 1), in order to improve the efficiency of an analysis, measurements are performed by using one prepared high-concentration quantitative calibrator while repeating automatic dilution several times as needed, thereby reducing the time-consuming tasks for preparing a plurality of kinds of standard solutions and human errors.

Moreover, Japanese Patent Application Laid-Open Publication No. 2000-65797 (Patent Document 2) has proposed an analyzing method using a stable isotope compound, in which a calibration curve is formed by measuring an analysis object by utilizing a ratio of natural isotopes contained in the analysis object itself.

PRIOR ART DOCUMENTS

Patent Documents

Japanese Patent Application Laid-Open Publication No. H5-79984

Japanese Patent Application Laid-Open Publication No. 2000-65797

SUMMARY OF THE INVENTION

Problems to be Solved by the Invention

However, in Patent Document 1, measurements need to be carried out a plurality of times, and the reduction of measurement time cannot be achieved.

Moreover, in the method of Patent Document 2, since the isotope ratio of elements of natural origin is used, there is a problem in that the measurement concentration range of a calibration curve is uncontrollable.

Therefore, an object of the present invention is to provide a mass analyzing apparatus capable of simply and quickly carrying out the formation of a calibration curve that requires the above-mentioned complicated operations and also reducing the analysis time spent for forming the calibration curve and the consumption of consumable supplies, thereby achieving the improvement of the analysis throughput.

The above and other objects and novel characteristics of the present invention will be apparent from the description of the present specification and the accompanying drawings.

Means for Solving the Problems

The following is a brief description of an outline of the typical invention disclosed in the present application.

That is, in the outline of the typical invention, with respect to one analysis object to be quantified, two or more kinds of compounds are selected as calibration substances from the analysis object, a plurality of stable isotope compounds of the analysis object and a plurality of analogue compounds of the analysis object, a quantitative calibrator in which the respective calibration substances are mixed at respectively different concentrations is prepared, two or more concentrations are measured in the quantitative calibrator by analyzing the calibration substances in the quantitative calibrator by a mass analyzing apparatus, and the analysis object is quantified based on the information of the measurement.

In this case, as shown in FIG. 1, the conditions of the substances used as the calibration substances are as follows. That is, the mass-to-charge ratios (m/z) of the peaks of the analysis object and the calibration substance are separated from each other by a resolving power of amass analyzer or more, and the mass spectrum peaks of the calibration substance and the stable isotopes contained in the analysis object are separated from each other by the resolving power of the mass analyzer or more, so that the m/z thereof are not overlapped with each other.

Moreover, the analyzing apparatus includes: a sample storing unit which stores samples of the analysis object including a quantitative calibrator in which, with respect to one analysis object to be quantified, two or more kinds of compounds selected from the analysis object, a plurality of stable isotope compounds of the analysis object and a plurality of analogue compounds of the analysis object are mixed at respectively different concentrations; an ionizing unit for ionizing the samples; a mass analyzing unit that analyzes the ionized samples; and a data processing unit that measures two or more concentrations based on the results of the analysis of the quantitative calibrator carried out by the mass analyzing unit and quantifies the analysis object based on the information of the measurement.

Effects of the Invention

The effects obtained by typical embodiments of the invention disclosed in the present application will be briefly described below.

That is, as the effects obtained by the typical invention, information that ensures quantification precision in a target concentration range can be formed by just measuring one kind of a quantitative calibrator only once, without the necessity of preparing a plurality of quantitative calibrators, and it becomes possible to achieve the speed-up and simplification of the quantitative analysis in a mass analyzing apparatus.

BRIEF DESCRIPTIONS OF THE DRAWINGS

BEST MODE FOR CARRYING OUT THE INVENTION

Figure 1:
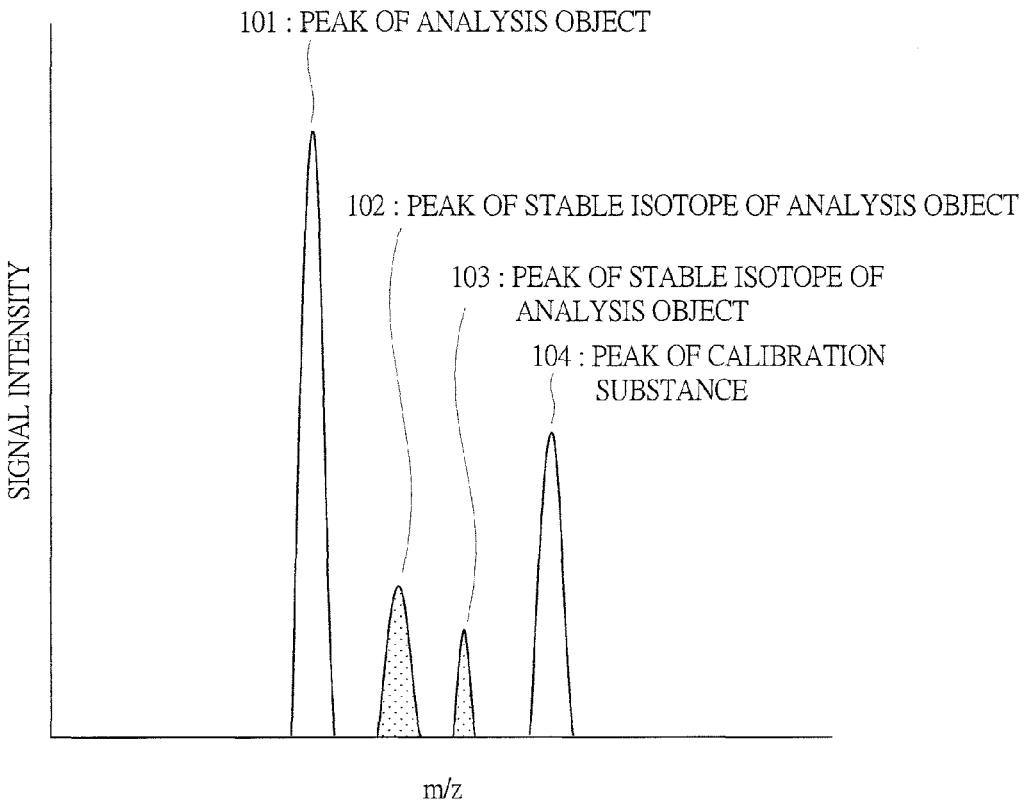
FIG. 1 is a mass spectrum for describing a relationship between an analysis object and calibration substances in amass analyzing apparatus of an embodiment of the present invention.

Hereinafter, embodiments of the present invention will be described in detail with reference to the accompanying drawings. Note that components having the same function are denoted by the same reference symbols throughout the drawings for describing the embodiments, and the repetitive description thereof will be omitted.

First, the outline of the present invention will be described.

In the present invention, in order to quickly carry out calibration and also to reduce consumption of consumable supplies, a quantitative calibrator (calibration sample) in which, with respect to one analysis object, two or more kinds of compounds selected from the analysis object itself, a plurality of stable isotope compounds and a plurality of analogue compounds are mixed at respectively different concentrations is used to measure a sample at multiple concentrations at the same time.

In other words, by measuring the quantitative calibrator once, a multi-point calibration curve having two or more points can be formed. In this case, with respect to the m/z of compounds of the plurality of calibration substances and the analysis object contained in the quantitative calibrator, the m/z at their peaks need to be separated from each other by a mass resolving power or more of the mass analyzer used for detection. Since a normal mass analyzer generally has the mass resolving power of about 1 m/z, the m/z at mass spectrum peaks of the respective compounds are preferably separated from each other by at least 1 Da, more preferably, by 3 Da or more.

In order to carry out an accurate measurement in the measurement of a sample containing many foreign components such as, in particular, a biological sample, an apparatus provided with an MS/MS method capable of detecting product ions is desirably adopted as a mass analyzer used for detection. In the case of using the MS/MS method, even when the m/z of precursor ions of a plurality of calibration substances contained in a quantitative calibrator are the same, there arises no problem if the m/z of the product ions are different.

Moreover, in order to appropriately carry out the input of information required for forming a calibration curve without any mistakes, the apparatus is provided with a database in which detailed information of the quantitative calibrator is stored or means for taking in the detailed information of the quantitative calibrator, and the apparatus is further provided with a mechanism which automatically takes in the composition and concentration of the quantitative calibrator to a database inside the apparatus by using an information medium such as an IC chip, a bar code or the like so as to make the detailed information of the quantitative calibrator linked with the results of sample measurements to form the calibration curve of the measurement sample.

In the case where theophylline (molecular weight: 180, structural formula: $C_7H_8N_4O_2$) is measured as an analysis object, the ratio of natural isotopes are calculated as follows:

Molecular weight 181=90.67%

Molecular weight 182=8.56%

Molecular weight 183=0.73%

Molecular weight 184=0.04%

For example, in the case of theophylline having a concentration of 100 μg/mL, natural isotopes of 90.67 μg/mL, 8.56 μg/mL, 0.73 μg/mL and 0.04 μg/mL are contained therein in accordance with the above-mentioned ratio.

In the case where a calibration curve is formed from four concentration points by using the above-mentioned natural isotope ratio in accordance with Patent Document 2, five-digit quantitative dynamic range is required. Moreover, even in the case where a calibration curve is formed from three concentration points (defined as High concentration, Middle concentration and Low concentration), four-digit quantitative dynamic range is required.

Theophylline, which is an analysis object taken as an example, serves as a medicine used as an anti-inflammatory drug or the like and has its effective blood concentration in a range of 8 to 20 μg/mL. When it is desired to accurately quantify the blood concentration range thereof by using a calibration curve with three-point concentrations, the measured concentration range of 2 to 50 μg/mL can be accurately quantified by forming the calibration curve based on the three points, that is, a High concentration of 50 μg/mL that is a value twice or more of the upper limit value of therapeutic blood concentration range, a Middle concentration of 20 μg/mL that is a value within the therapeutic blood concentration range, and a Low concentration of 2 μg/mL that is a value ½ or less of the lower limit value of the therapeutic blood concentration range. However, in the method of using the ratio of the natural isotopes described in Patent Document 2, it is not possible to control the concentration range required for the quantification, with the result that a calibration curve is formed at scattered intervals within a wide concentration range, and a reliable calibration curve cannot be obtained in comparison with the case where the calibration curve is formed by the use of the analyzing method of the present invention. More specifically, when the quantitative calibrator is adjusted so that the molecular weight 181 is set to 50 μg/mL, a concentration point having the next highest concentration is 4.72 μg/mL of the molecular weight 182. However, since the other molecular weights 183 and 184 substantially become the same concentration as the blank sample (concentration: 0), the obtained calibration curve is actually the same as a calibration curve based on two-point concentrations, with the result that the quantification precision is degraded.

The present invention utilizes a quantitative calibrator in which three kinds of compounds selected from theophylline, a plurality of stable isotope compounds of theophylline and a plurality of theophylline analogue compounds are artificially mixed at three-point concentrations required for a calibration curve with high precision. Thus, by using the quantitative calibrator for a three-point calibration curve that can accurately quantify a necessary concentration range, a calibration curve can be efficiently formed by the single measurement.

In the case where a normal mass analyzer having a mass resolving power m/z of about 1 is used as a detector, as shown in FIG. 1, the m/z of arbitrary two calibration substances that are mixed in the quantitative calibrator to be utilized are preferably separated from each other by the resolving power or more of the mass analyzer, that is, 1 Da or more, and more preferably, 3 Da or more, from the viewpoint of preventing the degradation in quantification precision caused by mutual interference. For example, in FIG. 1, a peak 101 of an analysis object, peaks 102 and 103 of stable isotopes of the analysis object and a peak 104 of a calibration substance are separated from one another by 1 m/z or more.

Moreover, preferably, when an isotope whose natural isotope ratio is small is used as the calibration substance, the concentration control by the use of artificial addition is facilitated. For example, although the natural isotope of molecular weight 184 is overlapped in the abundance ratio of the natural isotopes of theophylline, its abundance amount is so small as 0.04%, and is a negligible amount in the artificial concentration control. When the amount of the natural isotope ratio is not negligible (8.56% of molecular weight 182 in theophylline), the concentration may be controlled by determining the amount of artificial addition of calibration substance by taking into account this natural isotope ratio.

Other than theophylline mentioned above, with respect to the abundance ratio of natural isotopes of elements constituting an organic compound, for example, as indicated by oxygen in which $^{16}O$ is 99.76%, $^{17}O$ is 0.038% and $^{18}O$ is 0.20%, the difference in rates in the abundance ratio is large in most of elements, and it is not practical to apply the method of Patent Document 2 to a compound with a low mass.

On the other hand, the quantitative calibrator used in the present invention is a sample in which required kinds of materials selected from an analysis object itself, a plurality of stable isotope compounds of the analysis object and a plurality of analogue compounds of the analysis object are appropriately mixed at required concentrations, and the most accurate calibration curve within a required concentration range can be formed by measuring this sample once. Moreover, of course, also in the case of two or more analysis objects other than one analysis object, by preparing calibration substance sets each composed of a plurality of stable isotopes and analogues, mixing the two or more calibration substance sets corresponding to the two or more analysis objects as one quantitative calibrator, and then measuring this mixed sample once, two or more calibration curves corresponding to the two or more analysis objects can be formed with high precision.

Figure 2:
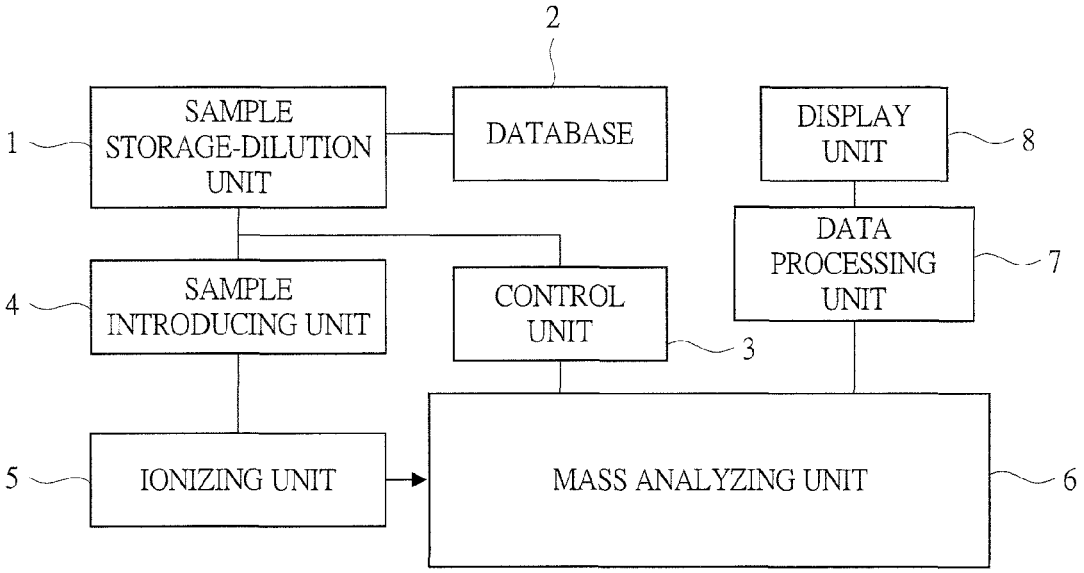
FIG. 2 is a block diagram showing a configuration of the mass analyzing apparatus of an embodiment of the present invention.

Next, a configuration of a mass analyzing apparatus of an embodiment of the present invention will be described with reference to FIG. 2. FIG. 2 is a block diagram showing the configuration of the mass analyzing apparatus of an embodiment of the present invention.

In FIG. 2, the mass analyzing apparatus is made up of a sample storage-dilution unit 1 in which a quantitative calibrator and other measurement samples or the like are stored and are diluted as needed, a database 2 in which detailed information of the quantitative calibrator is stored, a control unit 3 that controls the mass analyzing apparatus, a sample introducing unit 4 that introduces the quantitative calibrator and other measurement samples or the like, an ionizing unit 5 that ionizes the quantitative calibrator and other measurement samples or the like, a mass analyzing unit that analyzes the quantitative calibrator and the other measurement samples, a data processing unit 7 that processes analysis results in the mass analyzing unit 6, and a display unit 8 that displays the results processed in the data processing unit 7.

Figure 3:
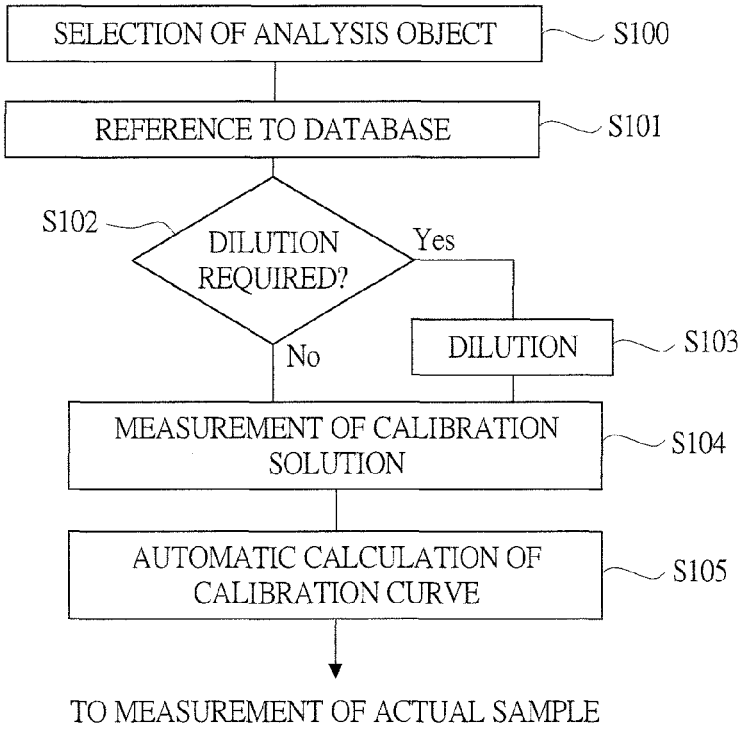
FIG. 3 is a flow chart showing a calibration curve forming process in the mass analyzing apparatus of an embodiment of the present invention.

Next, an analyzing method in the mass analyzing apparatus of an embodiment of the present invention will be described with reference to FIG. 3 and FIG. 4. FIG. 3 is a flow chart showing a calibration curve forming process in the mass analyzing apparatus of an embodiment of the present invention, and FIG. 4 is an explanatory diagram for describing an analyzing method in the mass analyzing apparatus of an embodiment of the present invention, in which an analyzing method using phenytoin as the analysis object is shown as an example.

In the formation of a calibration curve, as shown in FIG. 3, an analysis object is first selected (S100), and when measurement of phenytoin as an analysis object is inputted in S100, the database is referenced (S101) to determine whether a solution of a quantitative calibrator used for quantifying phenytoin stored in a reagent storing container in the sample storage-dilution unit 1 is measurable as it is or dilution is required therefor (S102), and if it is determined in S102 that the dilution is required, the process proceeds to a diluting step (S103), and then the solution of the quantitative calibrator is measured (S104).

Moreover, if no dilution is required in S102, the solution of the quantitative calibrator is measured (S104).

The measurement of the solution of the quantitative calibrator is carried out through the process in which the solution of the quantitative calibrator introduced via the sample introducing unit 4 is ionized in the ionizing unit 5, and is then analyzed in the mass analyzing unit 6.

Moreover, in the data processing unit 7, a calibration curve is automatically calculated based on the measurement results in S104 (S105), and information of the calculation result is displayed on the display unit 8.

Thereafter, an actual sample is measured, and its quantitative calculation is carried out based on the calibration curve calculated in S105, so that quantitative values of the analysis object contained in the actual sample can be obtained.

In this case, for the quantification of phenytoin (alias: 5,5-diphenyl hydantoin), stable isotope compounds that are different from phenytoin by 3 and 10 in mass number can be used.

Phenytoin ($C_{15}H_{12}N_2O_2$)=252

Stable isotope compound different from phenytoin by 3 in mass number (*$CC_{14}H_{12}$*$N_2O_2$)=255

Stable isotope compound different from phenytoin by 10 in mass number ($C_{15}H_2D_{10}N_2O_2$)=262

Note that phenytoin is a medicine used as an antiepileptic drug, and has a therapeutic blood concentration range of 5 to 20 μg/mL. For example, when a quantitative calibrator in which phenytoin and two kinds of stable isotope compounds of phenytoin are contained at a High concentration of 50 μg/mL that is a value twice or more of the upper limit value of therapeutic blood concentration range, a Middle concentration of 20 μg/mL that is a value within the therapeutic blood concentration range, and a Low concentration of 2 μg/mL that is a value ½ or less of the lower limit value of the therapeutic blood concentration range is used, a calibration curve that can accurately quantify the therapeutic concentration range as shown FIG. 4C can be formed from the measurement results as shown by chromatograms in FIG. 4B.

Figure 4A:
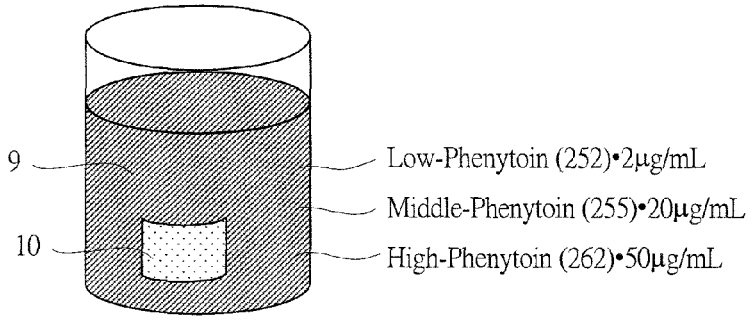
FIG. 4 is an explanatory diagram for describing an analyzing method in the mass analyzing apparatus of an embodiment of the present invention.
Figure 4B:
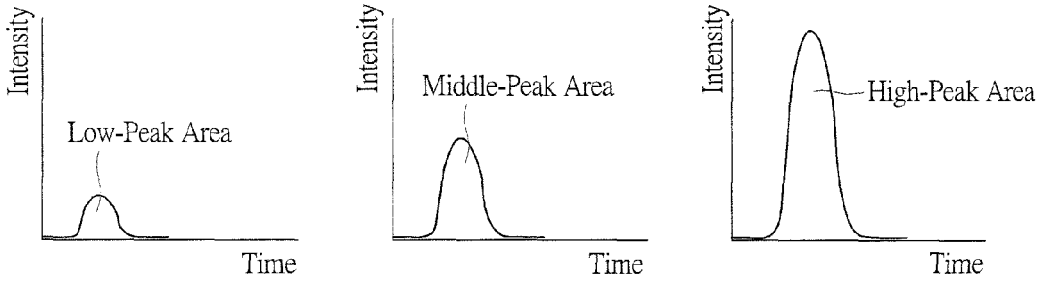
Figure 4C:
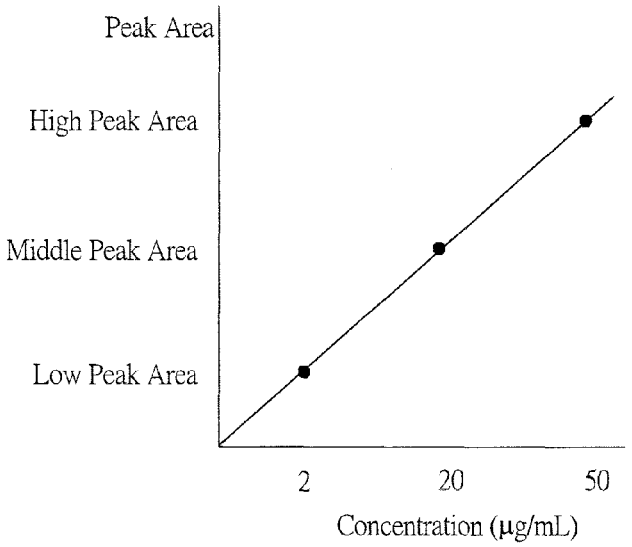

The quantitative calibrator is stored in, for example, a reagent storing container 9 shown in FIG. 4A in the sample storage-dilution unit 1. An information medium 10 such as an IC chip, a bar code or the like is attached to the reagent storing container 9, and when the reagent storing container 9 is put into the sample storage-dilution unit 1, the information medium 10 is read, and components contained in a solution of the quantitative calibrator and concentrations thereof are confirmed.

The reagent information may be stored in either the information medium 10 such as an IC chip or a bar code or the database 2, and in the case where it is stored in the database 2, it is confirmed which reagent has been put in from the information medium 10, and the corresponding information is taken out by referencing the database 2.

Alternatively, dilution may be executed prior to each of the measurements by storing the solution of the quantitative calibrator with a concentration higher than that required for the calibration curve in the reagent storing container 9.

Moreover, in the above-mentioned example, a three-point calibration curve has been described. Alternatively, when it is desired to form a calibration curve more accurately by utilizing a multi-point calibration curve from more points or it is desired to form a calibration curve having a wider concentration range for measuring a specimen whose blood concentration is an abnormal value, the quantitative calibrator may be diluted so as to obtain a quantitative calibrator having a different concentration from that of the solution of the quantitative calibrator stored in the reagent storing container 9. In that case, by carrying out measurements of the quantitative calibrator twice in total before and after the dilution, a calibration curve with 6-point concentrations can be formed.

More specifically, in the case where the solution of a quantitative calibrator containing components at a Low concentration of 50 μg/mL, a Middle concentration of 100 μg/mL and a High concentration of 200 μg/mL is stored in the reagent storing container 9, two kinds thereof, that is, the solution of the quantitative calibrator itself and the solution obtained by diluting the solution into 1/10 are measured respectively once, so that it is possible to form the calibration curve with 6-point concentrations of 5, 10, 20, 50, 100 and 200 μg/mL.

These dilution and measurement are controlled by the control unit 3 based on the data stored in the database 2.

Moreover, depending on analysis objects, due to such reasons as unavailability and high price of stable isotope compounds thereof, an analogue compound whose response to the mass analyzing apparatus of the quantitative calibrator is different from the analysis object is sometimes used as a calibration substance of the quantitative calibrator.

For example, a compound whose peak area is not equal but is detected as a certain constant ratio in the measurement of an analysis object and a quantitative calibrator each having the same concentration is sometimes used as a quantitative calibrator. In this case, by retaining information about a ratio relationship in peak area value between the analysis object and the calibration substance in the database 2 and returning a value obtained by multiplying the peak area value of the quantitative calibrator by a corresponding coefficient, a calibration curve can be formed in the same manner as in the case of a stable isotope compound.

As a matter of course, in the mass analysis, generated ions may be directly detected or specific product ions may be detected from the introduced ions. For example, in the case where the mass numbers of arbitrary two or more kinds of calibration substances are substantially the same or are not distinguishable by a mass analyzer, if the isotopes have product ions whose mass numbers are respectively different, by selecting ions derived from a specific calibration substance from the introduced ions in the mass analyzing unit 6 and detecting product ions obtained from the selected ions, separate measurement from the other calibration substances is possible, so that it can be used as a quantitative calibrator. Incidentally, as a method for causing dissociation in place of collision dissociation, there are photodissociation, electron transfer dissociation and electron capture dissociation, and any one of these may be used.

In the foregoing, the invention made by the inventors of the present invention has been concretely described based on the embodiments. However, it is needless to say that the present invention is not limited to the foregoing embodiments and various modifications and alterations can be made within the scope of the present invention.

For example, in the present embodiment, an example in which a calibration curve is formed has been described, but it is also possible to measure two or more concentrations by using a quantitative calibrator by means of table or calculation without forming the calibration curve, and the quantification can be carried out based on the information of the measurement.

INDUSTRIAL APPLICABILITY

The present invention is widely applicable to, for example, a mass analyzing apparatus for quantifying an analysis object by using a calibration curve.

EXPLANATION OF REFERENCE NUMERALS

1: sample storage-dilution unit, 2: database, 3: control unit, 4: sample introducing unit, 5: ionizing unit, 6: mass analyzing unit, 7: data processing unit, 8: display unit, 9: reagent storing container, 10: information medium

The invention claimed is:

1. An analyzing method in an analyzing apparatus for quantifying an analysis object, wherein, in order to quantify one analysis object by forming a multi-point calibration curve, two or more substances are selected from a standard substance of the analysis object, a stable isotope compound of the analysis object and an analogue compound of the analysis object as a calibrator for calibration curve, a calibrator for multi-point calibration curve is prepared by mixing the two or more substances at different concentrations, the calibrator for calibration curve is measured once, thereby forming a multi-point calibration curve, a real sample of the analysis object is measured, the measured value of the real sample is quantified by applying it to the calibration curve, and in the calibrator for calibration curve, a concentration of a calibration substance with the second highest concentration is not less than one tenth of a concentration of a calibration substance with the highest concentration.

2. The analyzing method according to claim 1, wherein the analyzing method is a mass analyzing method.

3. The analyzing method according to claim 2, wherein a difference in m/z of arbitrary two kinds of ions derived from calibration substances contained in the calibrator generated by a mass analyzing apparatus is greater than a resolving power m/z of the mass analyzing apparatus.

4. The analyzing method according to claim 2, wherein arbitrary two kinds of calibration substances contained in the calibrator are analyzed by the mass analyzing apparatus as mass spectrum signals that are different from each other by 3 m/z or more.

5. The analyzing method according to claim 2, wherein in order to quantify two or more kinds of analysis objects, the calibrator contains two or more kinds of calibration substance sets corresponding to the respective two or more kinds of analysis objects.

6. A mass analyzing apparatus for quantifying an analysis object, comprising:

a sample storing unit configured to: select two or more substances from a standard substance of the analysis object, a stable isotope compound of the analysis object and an analogue compound of the analysis object as a calibrator for calibration curve; and prepare a calibrator for multi-point calibration curve by mixing the two or more substances at different concentrations, wherein in the calibrator for calibration curve, a concentration of a calibration substance with the second highest concentration is not less than one tenth of a concentration of a calibration substance with the highest concentration;

an ionizing unit;

a mass analyzing unit; and a data processing unit configured to: measure the calibrator for calibration curve once, thereby forming a multi-point calibration curve; measure a real sample of the analysis object; and quantifying a measured value of the real sample by applying it to the calibration curve.

7. The mass analyzing apparatus according to claim 6, wherein the mass analyzing unit selects specific ions from ions generated by the ionizing unit and introduced into the mass analyzing unit, and applies energy to the selected ions to be dissociated, thereby detecting product ions thus generated.

8. The mass analyzing apparatus according to claim 7, wherein ions generated from arbitrary two calibration substances among two or more kinds of calibration substances are commonly selected and dissociated, and m/z of resultant two or more kinds of product ions are identified, thereby quantifying the arbitrary two calibration substances.

9. The mass analyzing apparatus according to claim 6, wherein the calibrator is stored in a reagent storing container to which an information medium for identifying information of at least a name of a compound contained in the calibrator and a concentration thereof is attached.

10. The mass analyzing apparatus according to claim 9, further comprising:

a database for storing the information of the calibrator corresponding to the information medium attached to the reagent storing container.

11. A calibration sample used in an analyzing apparatus for quantifying an analysis object, wherein the calibration sample is a mixture at different concentrations, of two or more substances selected from a standard substance of the analysis object, a stable isotope compound of the analysis object and an analogue compound of the analysis object as a calibrator for calibration curve; and in the calibrator for calibration curve, a concentration of a calibration substance with the second highest concentration is not less than one tenth of a concentration of a calibration substance with the highest concentration.

* * * * *